United States Patent [19]

Matsudaira et al.

[11] 3,977,140

[45] Aug. 31, 1976

[54] EARTHQUAKE RESISTANT STRUCTURE FOR SPHERICAL TANKS

[75] Inventors: Tadashi Matsudaira; Masaharu Kunieda; Takanori Kimura, all of Tokyo; Shinya Nakano, Yokohama, all of Japan

[73] Assignees: Ishikawajima-Harima Jukogyo Kabushiki Kaisha; Tokyo Gas Kabushiki Kaisha, both of Tokyo, Japan

[22] Filed: May 20, 1974

[21] Appl. No.: 471,202

[30] Foreign Application Priority Data

| | | |
|---|---|---|
| Feb. 21, 1974 | Japan | 49-20840 |
| Dec. 12, 1973 | Japan | 48-139810 |
| Feb. 21, 1974 | Japan | 49-20839 |

[52] U.S. Cl. ..... 52/167; 248/146

[51] Int. Cl.[2] ..... E02D 27/34

[58] Field of Search ..... 52/167, 573; 248/146, 248/346; 220/15, 18, 1 B

[56] References Cited

UNITED STATES PATENTS

| | | | |
|---|---|---|---|
| 2,055,000 | 9/1936 | Bacigalupo | 52/167 |
| 2,417,053 | 3/1947 | Boardman | 248/146 |
| 3,129,836 | 4/1964 | Frevel | 248/146 |
| 3,347,002 | 10/1967 | Penkuhn | 52/573 |
| 3,762,114 | 10/1973 | Eskijian | 52/573 |
| 3,767,150 | 10/1973 | Tabata | 248/146 |
| 3,794,277 | 2/1974 | Smedley | 52/167 |

*Primary Examiner*—Ernest R. Purser
*Assistant Examiner*—Robert C. Farber

[57] ABSTRACT

A plurality of dampers are arranged and interposed between a spherical tank and its foundation in such a way that when the foundation shakes in case of an earthquake so that the spherical tank vibrates or swings relative to the foundation, the amplitude of the relative vibrations of the spherical tank may be controlled by the dampers.

2 Claims, 14 Drawing Figures

Fig. 1
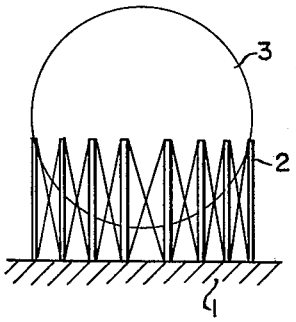
Fig. 2
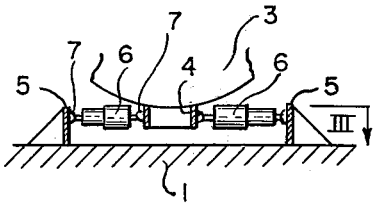
Fig. 3
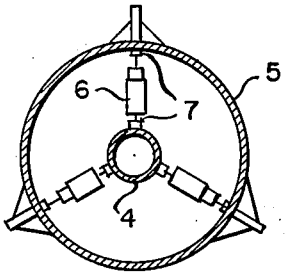
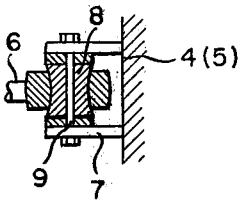
Fig. 4
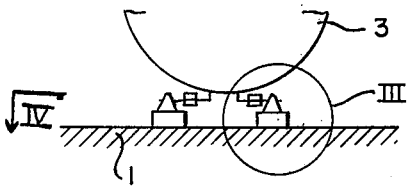
Fig. 5

Fig. 6
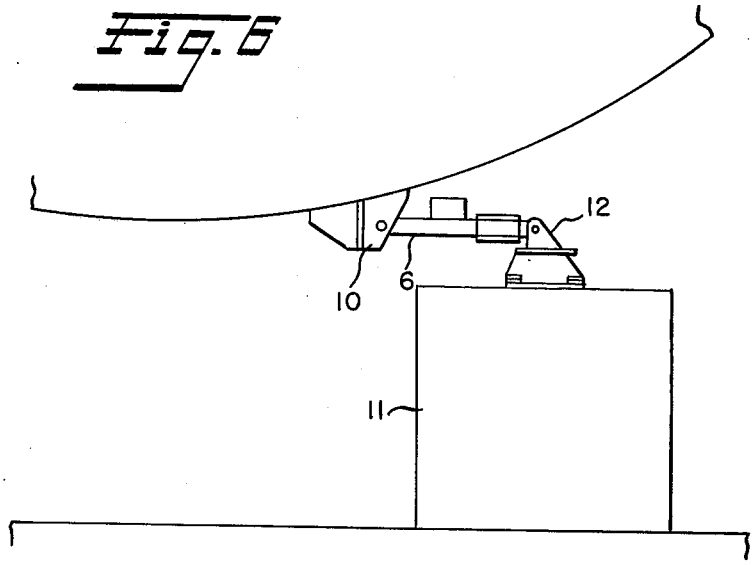
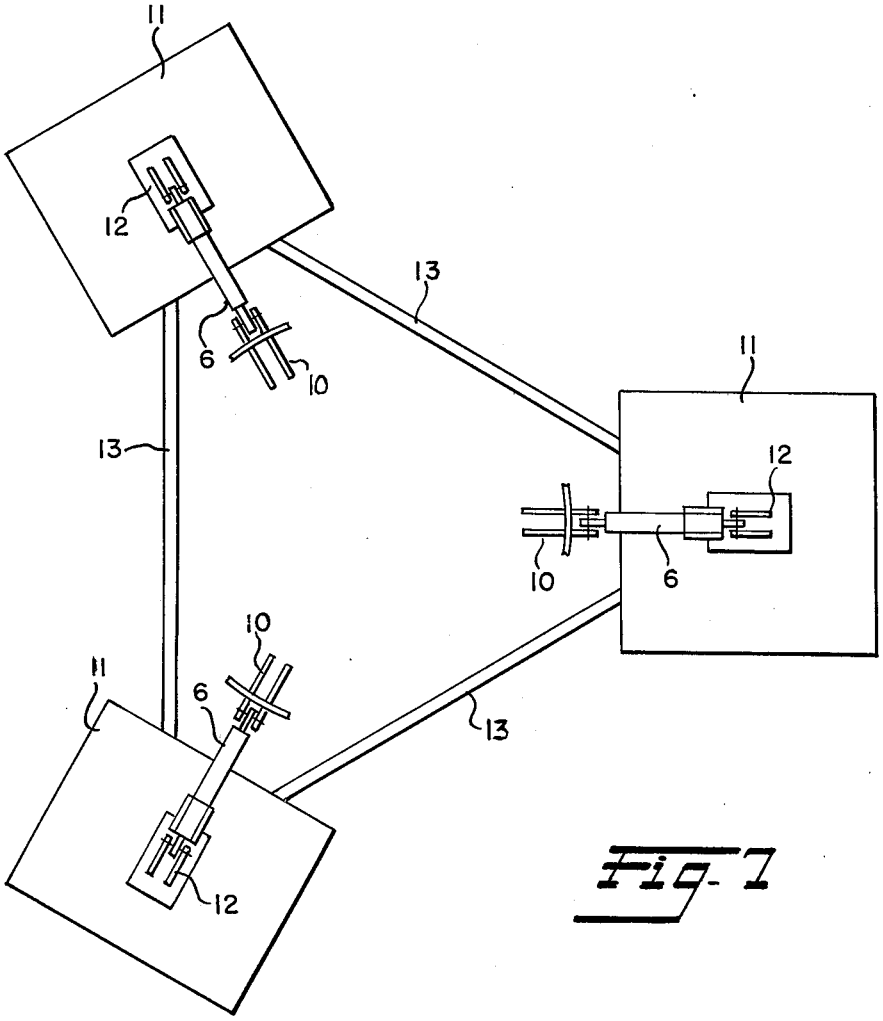
Fig. 7

EARTHQUAKE RESISTANT STRUCTURE FOR SPHERICAL TANKS

The present invention relates to an earthquake resistant structure for spherical tanks capable of considerably increasing the earthquake resistance of a spherical tank installation, thereby increasing the overall safety thereof.

The earthquake resistance of various plants has been recently taken into consideration in design and construction. Various machines, equipments and their pipe lines have an earthquake resistant structure. In case of sherical tank installations, the strength and rigidity capable of sufficiently resisting an earthquake have been also taken into consideration in design and construction. That is, the strength of the spherical tank supporting structures has been considerably increased than that of the existing ones. However, recently there has been found a very effective method for providing the earthquake-proofness or earthquake-resistance for spherical tank installations. That is, when a suitable damping mechanism is interposed in a spherical tank supporting structure, the amplitude of the vibrations of a spherical tank relative to its foundation may be considerably damped. Therefore, the safety of the spherical tank installation may be ensured. However, such a damping mechanism has not been incorporated yet in a spherical tank supporting structure in practice.

One of the objects of the present invention is therefore to provide an earthquake resistant structure for spherical tanks including a damping mechanism installed by various methods in accordance with the present invention, thereby increasing the earthquake resistance of the spherical tank installations.

Another object of the present invention is to provide various simple methods for installing the damping mechanism in such a way that the damping mechanism may not exert any detrimental restricting force to a spherical tank.

A further object of the present invention is to provide a method which permits the installation of the damping mechanism without providing a special foundation or foundations for supporting or retaining the damping mechanism.

The above and other objects, features and advantages of the present invention will become more apparent from the following description of some preferred embodiments thereof taken in conjunction with the accompanying drawing in which:

FIG. 1 is a front view of a spherical tank installation;

FIG. 2 is a front view of a first embodiment of the present invention;

FIG. 3 is a top view thereof looking in the direction indicated by the arrow III in FIG. 2;

FIG. 4 is a sectional view illustrating the joint between a damper and its supporting or retaining member;

FIG. 5 is a schematic front view of a second embodiment of the present invention;

FIG. 6 is a fragmentary view of port III of FIG. 5 on enlarged scale.

FIG. 7 is a top view thereof, on enlarged scale, looking in the direction indicated by the arrow IV of FIG. 5;

FIRST EMBODIMENT. FIGS. 1–4

Figure 9:
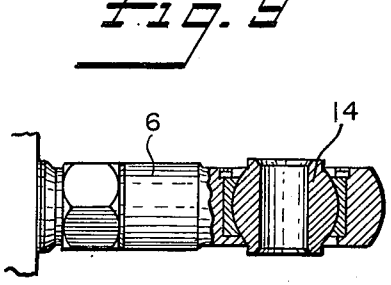
FIG. 9 is a side view, partly in section, of a variation of the joint of the damper.

Referring to FIG. 1, a spherical tank 3 is supported by a tank supporting mechanism or legs 2 erected upon a foundation 1 in such a way that the bottom of the tank 3 may be spaced apart from the foundation 1 by a predetermined distance. A cylindrical inner damper supporting or retaining member 4 is attached to the bottom of the tank 3 in such a way that the damper supporting member will not interfer with the required piping systems, and a cylindrical outer damper supporting member 5 whose diameter is larger than that of the inner damper supporting member 4 is erected upon the foundation 1. A plurality of horizontal dampers 6 are interposed between the inner and outer damper supporting members 4 and 5. In the instant embodiment, three horizontal dampers 6 are interposed in equiangularly spaced apart relation from each other as best shown in FIG. 3. More particularly, the ends of the dampers 6 are supported by brackets 7, which in turn are attached to the inner and outer damper supporting members 4 and 5, in such a way that the forces exerted to the joint between the damper 6 and the bracket 7 under any load except to the load in the axial direction may be released. That is, as shown in FIG. 4, a cushion or shock isolation rubber 8 is fitted into an attachment hole formed at the end of the damper 6, and is linked to the bracket 7 with a pin 9. Thus, the wrenching caused by the displacement of the joint between the damper 6 and the jacket 7 in any direction except the axial direction of the damper may be released.

When an earthquake happens, the foundation 1 shakes so that the spherical tank 3 starts to swing in the horizontal direction relative to the foundation 1 because the tank 3 is supported elastically by the legs 2. Then, the dampers 6 function so that the amplitude of the swing or vibration of the tank 3 relative to the foundation 1 may be controlled. More particularly, since the dampers 6 are interposed horizontally between the tank 3 and the foundation 1, the swing or vibrations of the tank 3 with respect to the foundation 1 are absorbed by the dampers 6 so that the amplitude of the vibration of the tank may not become large. Therefore, the stresses produced inside the legs 2 may not be brough up, and the spherical tank 3 may be earthquake-proofed. In case of an earthquake, the tank is exerted with the forces from various directions so that it swings or vibrates in various directions. But the vibration of the tank 3 in the horizontal direction relative to the foundation 1 is controlled by the dampers 6. The joint between the damper 6 and the bracket 7 is subjected to the forces from the various directions except the direction of the axis of the damper 6 so that the joint is subjected to wrenching. But according to the present invention, the joint of the type shown in FIG. 4 is used so that the wrenching of the joint may be released.

In the instant embodiment, the cylindrecal outer damper supporting member 5 is used, but it is to be understood that separated outer damper supporting members equal in number to the dampers used may be erected upon the foundation. Furthermore, these individual outer supporting members may be interconnected with each other by suitable means.

SECOND EMBODIMENT. FIGS. 5–8

Figure 8:
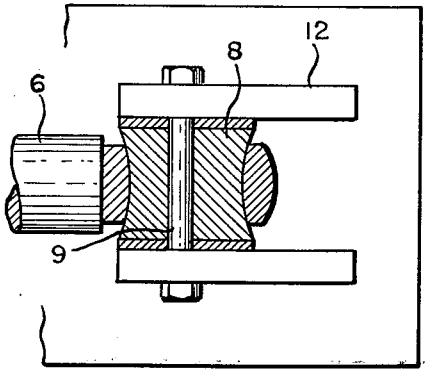
FIG. 8 is a sectional view illustrating the joint between a damper and a tank in the second embodiment.

Three brackets 10 are joined by welding to the bottom of the spherical tank supported by the legs 2 in equiangularly spaced apart relation (by 120°) in the same horizontal plane. Three foundations 11 are formed upon the foundation 1 in such a way that each foundation 11 is aligned with the extension of the axis of the bracket 10, and these three damper supporting foundations 11 are interconnected by connecting members 13 as shown in FIG. 7. One end of each damper 6 is fixed to the bracket 10 attached to the tank 3 while the other end is fixed to a bracket 12 mounted on the damper supporting foundation 11 as shown in FIG. 8 in a manner substantially similar to that described in the first embodiment with reference to FIG. 4. That is, the cushion or shock isolation rubber 8 is fitted into the attachment hole formed at each end of the damper 6 and is fixed to the bracket 10 or 12 with the pin 9. Therefore, the wrenching of the joint between the damper 6 and the bracket 10 or 12 under the forces in any direction except the direction of the axis of the damper 6 may be released.

It is to be understood that instead of interconnecting the damper supporting foundations 11 through the connecting members 13, they may be directly joined to each other in such a way that the arrangement and installation of the piping system for the tank 3 may not be adversely affected. Furthermore, the damper supporting foundations 11 may be increased in size to provide the sufficient strength so that the connecting members 13 may be eliminated.

Next referring to FIG. 9, a variation of the joint between the damper 6 and the bracket 10 or 12 will be described. A ball-shaped member 14 with a vertical thorough hole is slidably fitted into a mating hole in the damper 6 so that the damper 6 may be coupled to the bracket with a pin fitted into the thorough hole in the ball-shaped member 14.

Figure 10:
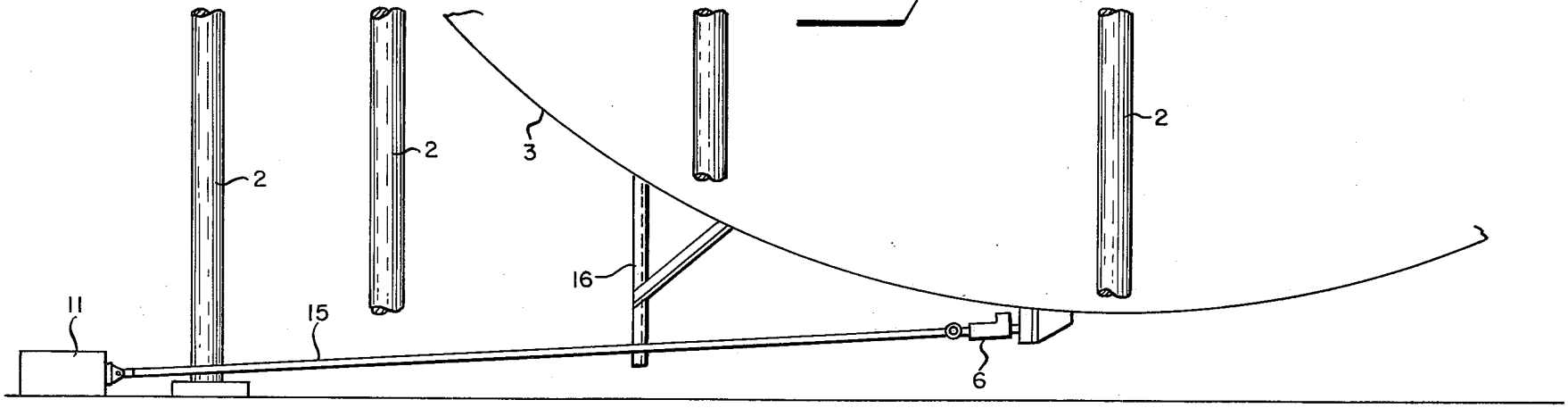
FIG. 10 is a schematic fragmentary side view of a third embodiment of the present invention.
Figure 11:
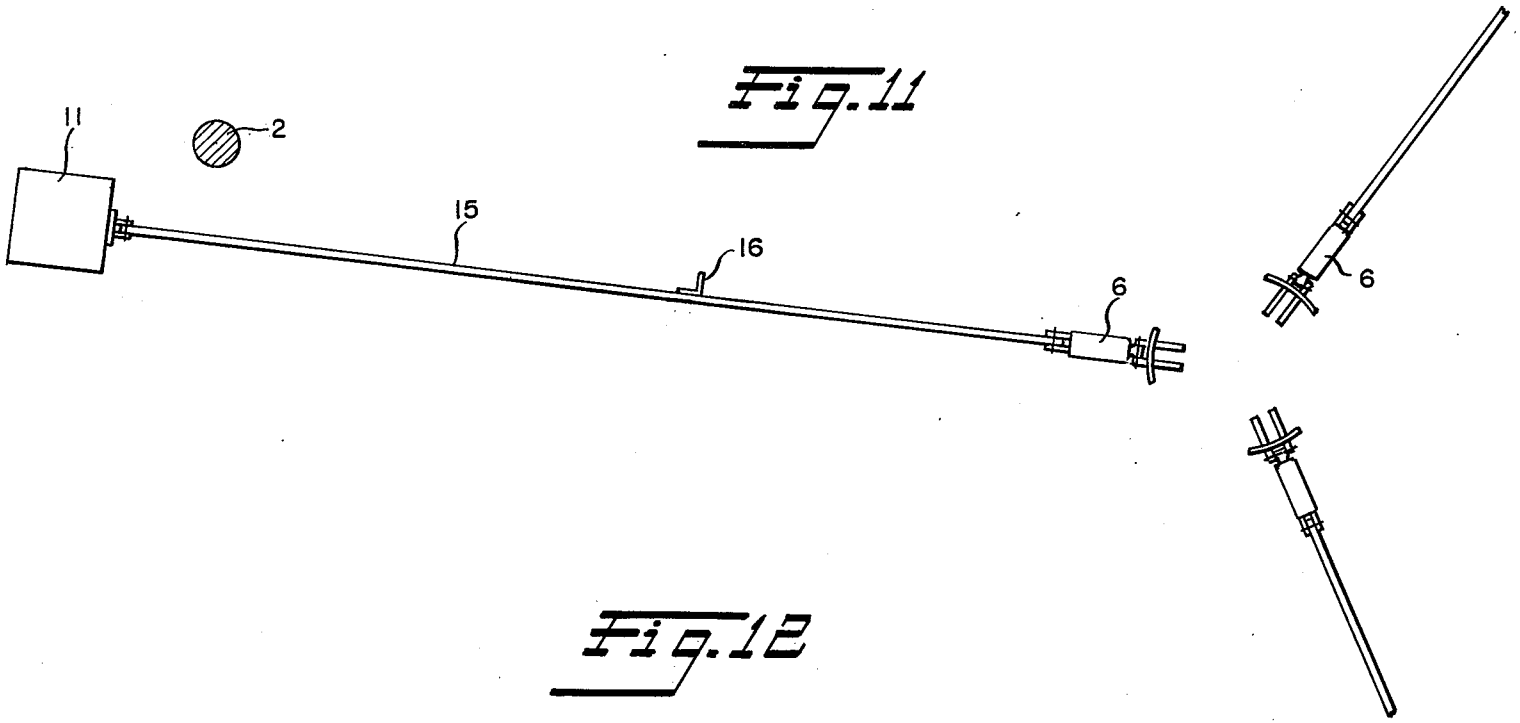
FIG. 11 is a top view thereof.

THIRD EMBODIMENT. FIGS. 10 and 11

In the second embodiment the damper supporting foundations 11 are formed immediately below the tank 3, but in the third embodiment they are formed upon the foundation 1 outwardly of the tank 3. The damper 6 is coupled to the supporting foundation 11 through a connecting rod 15. The connecting rod 15 is linked to the damper in a manner substantially similar to that described above with reference to FIG. 4 or FIG. 9. Furthermore, the connecting rod 15 is supported at the midpoint thereof by a supporting member 16 which in turn is attached to the bottom of the tank 3.

The third embodiment has an advantage that the damper supporting foundations 11 may be installed even after the installation of the spherical tank 3. That is, in some case, the construction of the damper supporting foundations 11 cannot be made because of the various pipe lines installed below the tank 3. However, according to the third embodiment the foundations 11 may be constructed outwardly of the tank 3 so that the dampers 6 may be attached even after the tank 3 has been installed.

It is to be understood that instead of supporting the connecting rod 15 from the tank 3, the rod 15 may be supported on the foundation and, that the supporting foundations 11 are interconnected to each other by the connecting members as shown in FIG. 7 or are directly joined to each other. Furthermore instead of the brackets 10, the cylindrical supporting member 4 shown in FIGS. 2 and 3 may be used.

Figure 12:
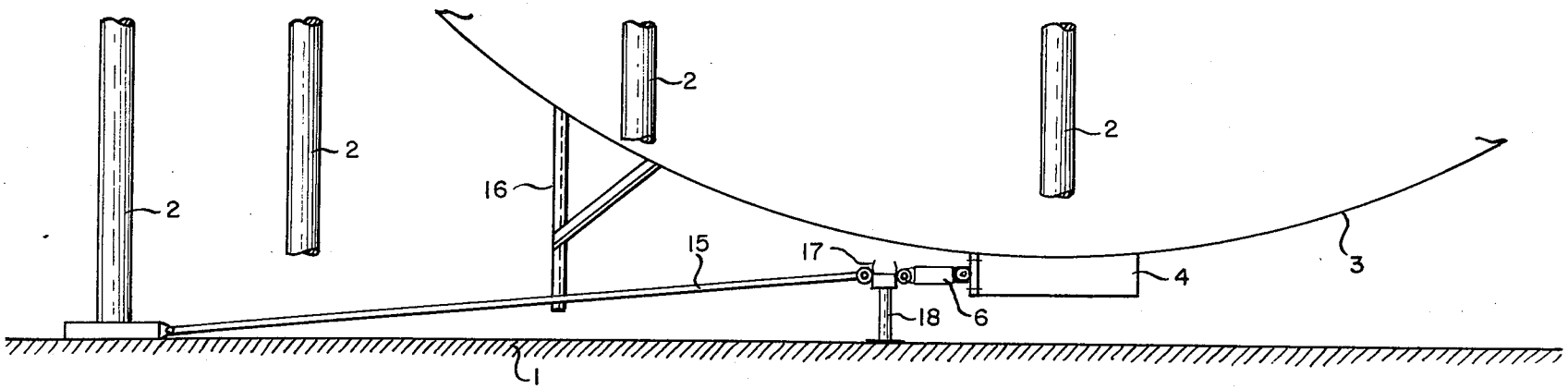
FIG. 12 is a schematic fragmentary side view of a fourth embodiment of the present invention.
Figure 13:
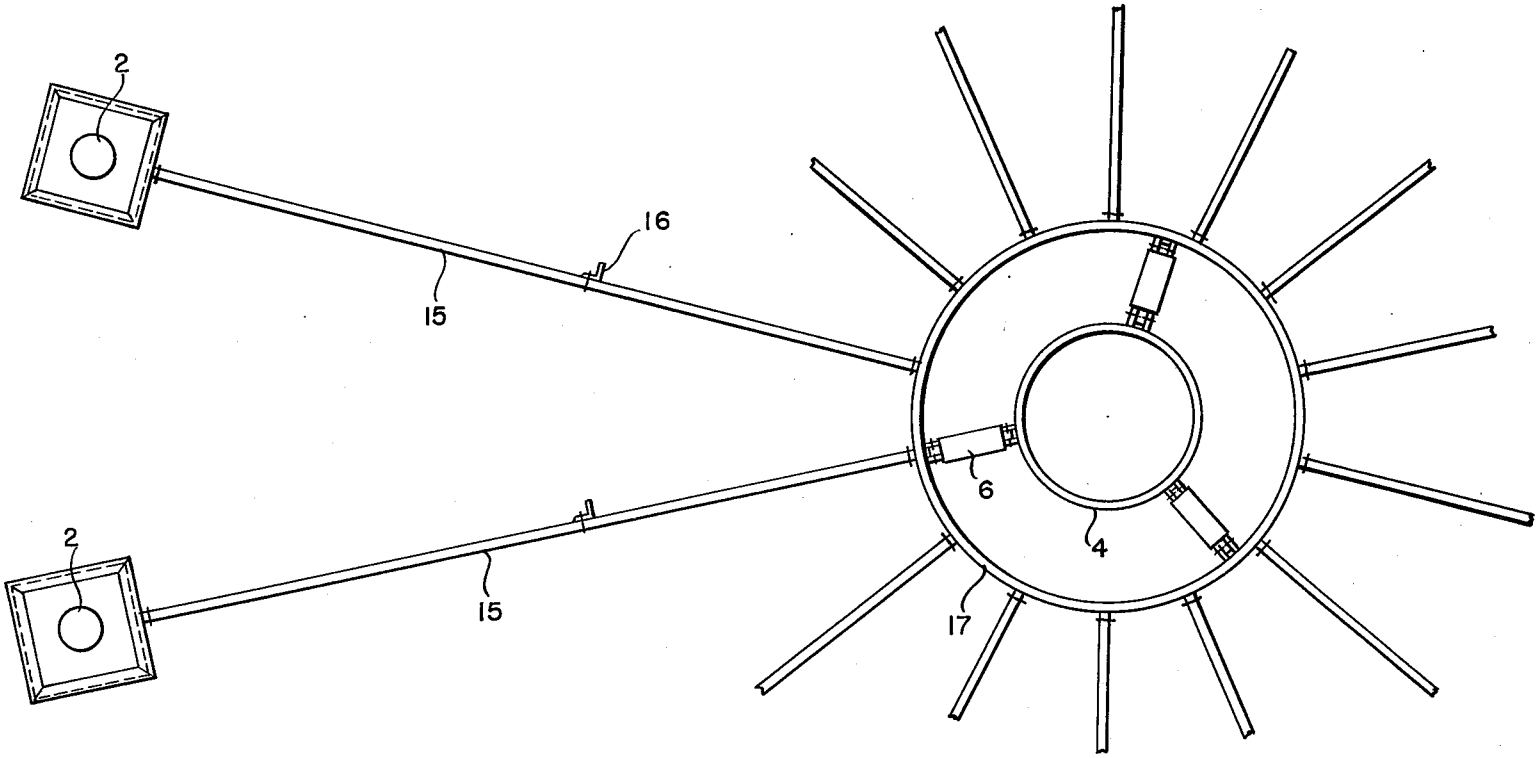
FIG. 13 is a top view thereof.

FOURTH EMBODIMENT. FIGS. 12 and 13

The cylindrical supporting member 4 is attached to the bottom of the tank 3 supported by the legs 2 in such a way that the damper supporting member 4 will not interfer with the various piping systems. A cylindrical damper supporting member 17 whose diameter is larger than that of the member 4, is installed coaxially of the inner supporting member 4 upon a plurality of supports 18 erected upon the foundation 1. Three dampers 6 are interposed between the inner and outer damper supporting members 4 and 17 in equiangularly spaced apart relation as shown in FIG. 13. The dampers are coupled to the inner and outer supporting members 4 and 17 in a manner substantially similar to that described above with reference to FIGS. 4, 8 so that the wrenching of the joint between the damper and the bracket may be released even when the forces are exerted to the joint from the various directions except the direction of the axis of the damper 6. A plurality of connecting rods 15 have their ends pivoted to the outer supporting member 17 and the legs 2 so that the forces exerted to the tank 3 may be distributed through the radially outwardly extending connecting rods 15. When the length of the connecting rods 15 is too long, they may be suspended from the tank 3 through the supporting member 16 pivoted to the tank 3 and the connecting rod 15.

When an earthquake happens, the foundation 1 shakes so that the tank 3 swings or vibrates in horizontal direction relative to the foundation 1, but the amplitude of the horizontal vibrations of the tank 3 may be controlled by the dampers 6. In this case the forces are distributed through the connecting rods 15 and transmitted to the legs 2. Furthermore, since the legs 2 are used, it is not necessary to provide the supporting foundations 11 as in the case of the second and third embodiments.

It is to be understood that instead of the cylindrical damper supporting member 4, a supporting member polygonal in cross section may be used and that it is not necessary to couple the supporting member 17 through the connecting rods 15 to all of the legs 2, that is the outer supporting member 17 is coupled through the connecting rods 15 to a suitable number of legs 2. Furthermore, instead of the cylindrical damper supporting member 4, the brackets such as those used in the second and third embodiments may be used. Moreover, the dampers may be interposed between such brackets and the outer supporting member 17 which has a polygonal cross section.

Figure 14:
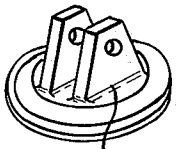
FIG. 14 is a perspective view of a member attached to the bottom of a spherical tank for supporting or retaining a damper.

So far only four embodiments of the present invention have been discribed, but it will be understood that the present invention is not limited thereto and that various modifications may be effected. For instance, the number of the dampers 6 may be more than three. In the second and third embodiments in which the damper retaining brackets 10 are attached to the tank 3 and the supporting foundations 11 are used, the number of the brackets 10 and foundations 11 may be determined depending upon the number of the dampers 6 used. Furthermore, instead of the bracket 10 attached to the tank 3, a forged damper retaining member 19 as shown in FIG. 14 may be used. The retaining member 19 is inserted into a mating hole formed in the spherical tank 3 and securely joined thereto by welding. Moreover, the dampers of various types such as a damper capable of producing the damping force in response to the speed of the relative vibrations, a dry friction type damper, a damper capable of producing the damping force in proportion to the square of the speed may be used. Furthermore, any device capable of producing the damping forces and/or friction forces may be used in the present invention. In addition to the above modifications, various modifications can be effected without departing the true spirit of the present invention. The earthquake resistant structure in accordance with the present invention may be of course applied to any building upon the ground in addition to the spherical tanks.

The advantages of the present invention may be summarized as follows:

i. The amplitude of the vibrations of the spherical tank relative to the foundation caused by an earthquake may be effectively controlled. Thus, the resistance of the spherical tank against earthquake may be considerably increased.

ii. Because of the advantage (i), the distortions and stresses of the tank legs and pipe lines are effectively restrained so that the earthquake-proofness and safety may be considerably enhanced.

iii. The joints of the dampers may be made free from wrenching under the loads from various directions so that the breakdown of the joints may be prevented.

iv. The supporting members for retaining the dampers upon the foundations may be made integral so as to reinforce each other so that the earthquake resistance may be considerably increased.

v. The attachment of the dampers is very simple so that the damper installation may be safely and quickly carried out.

vii. A suitable number of damper retaining members are attached to the suitable positions of the bottom of the tank independently from each other so that no detrimental restricting force is exerted to the tank.

viii. The damper supporting foundations are made integral when a plurality of dampers are used so that the foundations may reinforce each other with the result of the increase in the earthquake-proofness. Furthermore, the sizes of the damper supporting foundations may be decreased.

ix. The damper supporting or retaining foundations may be installed outwardly of the tank so that the dampers may be installed after the installation of the tank.

x. The dampers may be retained by the legs of the tank so that the loads acting in the axial direction of the dampers may be transmitted to the legs and the foundations for retaining the dampers may be eliminated.

What is claimed is:

1. An earthquake resistant support for spherical tanks having a plurality of supporting elements interposed between a foundation and the bottom of the tank, a primary support means composed a plurality of legs fixed to the foundation and adapted to support the tank in spaced relation thereto, a secondary support means comprising an inner, cylindrical supporting member attached to the bottom of the tank, an outer cylindrical supporting member spaced from said inner member and fixed to the foundation, brackets attached to the outer surface of the inner supporting member, brackets attached to the inner surface of the outer supporting member, dampening units disposed between the brackets, the ends thereof being attached to the respective brackets and pivotally connected thereto, the brackets including resilient means to cushion shocks caused by displacement of the joint between the dampers and the brackets.

2. An earthquake resistant support as defined in claim 1 wherein the dampening units are horizontally disposed.

* * * * *